US006516877B2

(12) United States Patent
Terry

(10) Patent No.: US 6,516,877 B2
(45) Date of Patent: Feb. 11, 2003

(54) SUCKER ROD PROTECTOR

(76) Inventor: Marcus Terry, P.O. Box 681, Burnet, TX (US) 78611

( * ) Notice: Subject to any disclaimer, the term of this patent is extended or adjusted under 35 U.S.C. 154(b) by 33 days.

(21) Appl. No.: 09/764,494

(22) Filed: Jan. 17, 2001

(65) Prior Publication Data

US 2002/0092647 A1 Jul. 18, 2002

Related U.S. Application Data

(63) Continuation-in-part of application No. 08/964,482, filed on Nov. 5, 1997, now abandoned.

(51) Int. Cl.[7] ..... E21B 17/10

(52) U.S. Cl. ..... 166/241.2; 166/241.1; 175/325.1

(58) Field of Search ..... 166/241.2, 241.1, 166/176, 369, 380; 175/325.1, 325.2, 325.4, 325.5, 399; 29/898, 898.03, 898.042, 898.054, 236; 285/16, 135.3, 392, 121.5; 403/80, 118, 52, 26; 384/276, 29; 211/70.4

(56) References Cited

U.S. PATENT DOCUMENTS

| | | | | | |
|---|---|---|---|---|---|
| 1,947,969 | A | | 2/1934 | Browne | 166/241.2 |
| 2,244,104 | A | * | 6/1941 | Fitzpatrick | 166/176 |
| 2,247,564 | A | | 7/1941 | Turner | 166/241.2 |
| 2,307,688 | A | | 1/1943 | Larson | 166/241.2 |
| 2,389,906 | A | | 11/1945 | Heard | 166/241.2 |
| 2,690,934 | A | | 10/1954 | Holcombe | 166/241.2 |
| 2,725,264 | A | | 11/1955 | Bodine, Jr. | 166/241.2 |
| 2,847,260 | A | * | 8/1958 | Dillon | |
| 3,080,926 | A | * | 3/1963 | Remp, Jr. | 166/173 |
| 3,292,708 | A | * | 12/1966 | Mundt | 166/173 |
| 3,370,894 | A | * | 2/1968 | Pourchot | 166/241.4 |
| 4,099,564 | A | * | 7/1978 | Hutchison | 166/241.1 |
| 4,621,690 | A | * | 11/1986 | Klyne | 166/176 |
| 4,858,688 | A | | 8/1989 | Edwards et al. | 166/241.2 |
| 4,919,205 | A | * | 4/1990 | Dollison | 166/241.3 |
| 5,027,914 | A | * | 7/1991 | Wilson | 166/55.6 |
| 5,119,876 | A | | 6/1992 | Sable | 166/241.2 |
| 5,487,426 | A | * | 1/1996 | O'Hair | 166/241.4 |
| 5,740,862 | A | * | 4/1998 | Sable | 166/241.2 |

* cited by examiner

*Primary Examiner*—David Bagnell
*Assistant Examiner*—T. Shane Bomar
(74) *Attorney, Agent, or Firm*—Mark R. Wisner

(57) ABSTRACT

An apparatus for reducing abrasive wear within a housing that includes a body having at least one protrusion selectively positioned and extending outwardly from the outer surface thereof, the body being placed concentrically within the housing and rubbing against the inside surface thereof as the body is moved within the housing. The body is provided with a plurality of slides residing in a like number of grooves formed on the outside surface thereof, each of the slides having a groove formed in at least one side surface thereof The slides are affixed to the body by deforming the material comprising the body into the groove formed in the slide by striking the surface of the material comprising the body adjacent the groove in which the slide resides with enough force to deform the material comprising the body into the groove formed in the side surface of the slide. The apparatus is particularly effective for use with the sucker rod of a pump jack for a subterranean petroleum well.

7 Claims, 1 Drawing Sheet

SUCKER ROD PROTECTOR

This application is a continuation-in-part of prior application Ser. No. 08/964,482, filed Nov. 5, 1997, and now abandoned.

BACKGROUND OF THE INVENTION

The present invention relates to apparatus, for protecting sucker rods from wear. More specifically, the present invention relates to apparatus that are attached to the sucker rods of an oil well to protect the sucker rods from damage due to abrasion as oil is pumped from the well.

As is common practice in the oil industry, pump jacks serve to create a pumping action in the tubing of a subterranean well, causing petroleum fluids from underground formations to flow into the tubing. A pump jack typically includes a polished rod that extends from the wellhead down into the well hole. A sucker rod may pass through tubing within the well.

The pump jack, in operation moves the polished rod up and down. In such movement, the sucker rod may stress and bend, becoming situated against the tubing wall. The movement of the sucker rod against the tubing wall is abrasive and the abrasion wears the sucker rod and the wall, resulting in damage and destruction to the tubing, sucker rod, and any sucker rod boxes.

It has long been desired to minimize and/or even eliminate this abrasive wear problem. For instance, the patent literature includes several U.S. Pat. Nos. 2,247,564, 2,307,688, 2,690,934, 2,725,264, 2,389,906, and 4,858,688, dating from the 1930's, that disclose sucker rod guides and/or sucker rod boxes that are intended to address this problem. However, so far as is known, all the sucker rod guides and/or boxes disclosed in these patents are characterized by certain disadvantages and/or limitations that decrease their utility.

There is, therefore, a need for improved sucker rod guides and boxes, and it is an object of the present invention to provide apparatus for meeting this need.

It is also an object of the present invention to provide a new and novel construction useful for minimizing abrasive wear on any member that is slidably mounted within a housing.

Another object of the present invention is to provide an apparatus for mounting to sucker rods and an apparatus for connecting sucker rods that minimizes abrasive wear on the sucker rods.

Another object of the present invention is to lengthen the service life of the sucker rods in a producing well.

Other objects, and the advantages, of the present invention will be made clear to those skilled in the art by the following description of the presently preferred embodiments thereof.

SUMMARY OF THE INVENTION

These objects are achieved by providing an apparatus for mounting to a member that is slidably mounted in a housing to minimize abrasive wear of the member and the housing upon sliding movement of the member in the housing comprising a generally elongate body, a plurality of longitudinal grooves in the outer surface of the elongate body, and an elongate slide residing in the longitudinal groove and protruding radially outwardly from the outer surface of the elongate body. Each slide is provided with a groove in at least one side surface thereof, the material comprising the body being deformed into the groove in the side surface of the slide for affixing the slide to the body in the longitudinal grooves. In a preferred embodiment, the apparatus is configured as a sucker rod guide and/or sucker rod box for minimizing abrasive wear on the sucker rods and tubing of an oil well.

DETAILED DESCRIPTION OF THE PREFERRED EMBODIMENT

Figure 1:
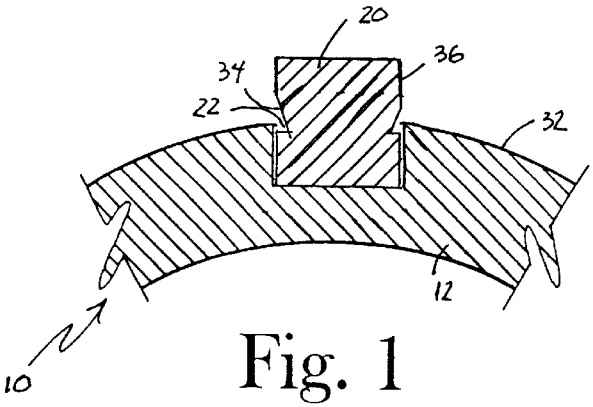
FIG. 1 is a partial cross-sectional view of a preferred embodiment of an apparatus for connecting two sucker rods constructed in accordance with the teachings of the present invention showing the sucker rod box before final assembly of the slide to the body thereof.
Figure 2:
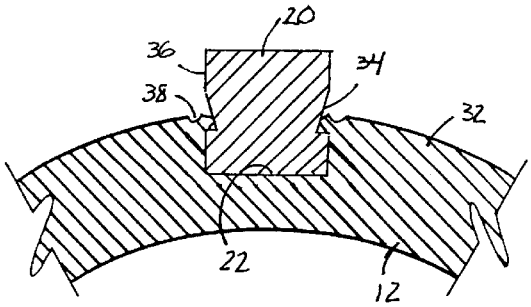
FIG. 2 is a partial cross-sectional view of the apparatus of FIG. 1 showing the sucker rod box after final assembly.
Figure 3:
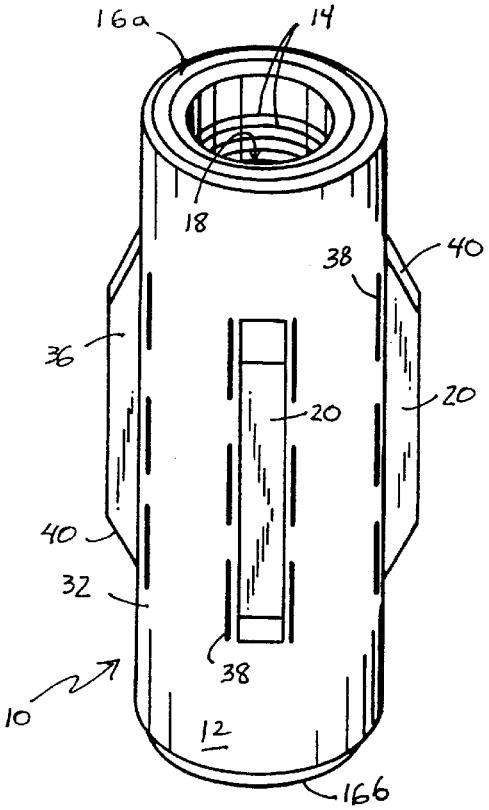
FIG. 3 is a perspective view of the sucker rod box of FIG. 1.

Referring to FIGS. 1, 2, and 3, a preferred embodiment of an apparatus constructed in accordance with the teachings of the present invention is indicated generally at reference numeral 10. The apparatus 10 is comprised of a generally elongate body 12 which, in the preferred embodiment shown in FIGS. 1–3, is cylindrically-shaped. The cylindrically-shaped body 12 may, for example, be a length of tubing or other similar cast, molded, or extruded cylindrical tube piece. In the embodiment shown, the cylindrical body 12 is formed with threads 14 internally at each end 16*a*, 16*b* thereof In the preferred embodiment shown in the figures, the threads 14 extend internally and longitudinally into the bore 18 of the cylindrically-shaped body 12 for sufficient distance, such as from about one half to about three inches for receiving the threaded ends of two sucker rods (not shown).

Externally around the outer circumference of the cylindrically-shaped body 12, a plurality of slides 20 are positioned in a like number of longitudinally-extending grooves 22 (best shown in FIG. 1) formed in the outer surface of body 12. The longitudinal grooves 22 and slides 20 residing therein may be spaced equidistance around the circumference of the cylindrically-shaped body 12 or otherwise. Furthermore, the slides 20 may be spaced along the length of the cylindrically-shaped body 12. In any event, the slides 20 are selectively positioned on the cylindrically-shaped body 12 so that body 12 cannot easily contact the tubing of a well bore when the apparatus 10 is used to join two sections of sucker rod in the well and the sucker rods, connected by the apparatus 10, is moved longitudinally therethrough. That is, rather than the body 12 of apparatus 10 contacting the tubing during movement of the sucker rods in the well, only the slides 20 contact the tubing during such movement. As may be readily understood and appreciated by those skilled in the art, one or more apparatus 10 are used as sucker rod boxes that may be run wild multiple segments of sucker rods, the number of boxes in any application depending upon the length necessary to reach from the wellhead to the desired location downhole. Those numbers will also depend upon the forces exerted on the segments of sucker rods, the deviation of the well bore, the speed of movement of the segments of sucker rods made up with the boxes, and other factors.

Figure 4:
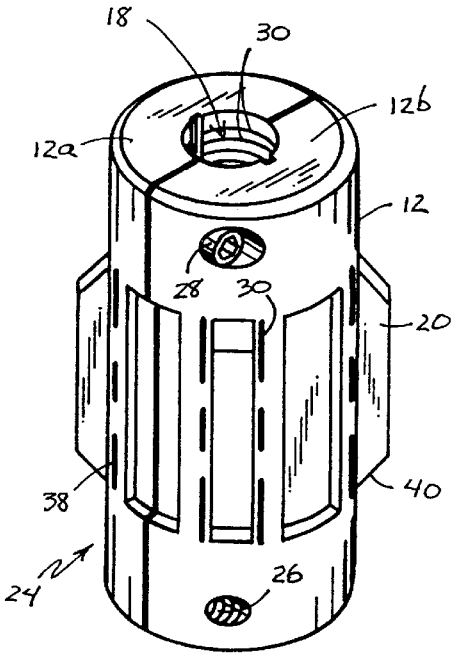
FIG. 4 is a perspective view of a sucker rod guide constructed in accordance with the teachings of the present invention.

Referring to FIG. 4, a second preferred embodiment of the apparatus 10 of the present invention, specifically as a sucker rod guide, is indicated generally at reference numeral 24. Like the sucker rod box 10 shown in FIGS. 1–3, sucker rod guide 24 is comprised of an elongate, preferably cylindrically-shaped body 12, but in the case of sucker rod guide 24, the body 12 is split into two sections 12*a*, 12*b* along its longitudinal axis and the two sections 12*a*, 12*b* are provided with means for selectively joining the sections 12*a*, 12*b* around a sucker rod (not shown) received in the bore 18 through body 12. In the preferred embodiment shown in FIG. 4, joining means comprises a plurality of threaded holes 26 for receiving a hex bolt (Allen wrench) 28 therein. When used as a sucker rod guide as contemplated for the embodiment of apparatus 10 shown in FIG. 4, it may also be advantageous to apply an epoxy or other adhesive to each of the bolts 28 after the bolts 28 are tightened to join the two sections 12*a*, 12*b* of body 12 around a sucker rod to decrease the likelihood that the bolts 28 will work their way loose with wear or vibration. The internal walls of the bore 18 formed by joining the two sections 12*a*, 12*b* of body 12 may be provided with a plurality of threads or annular teeth 30 to bite into the surface of the sucker rod received in bore 18 when the bolts 28 are tightened to prevent movement of the sucker rod guide 24 along the sucker rod.

When the apparatus 10 of the present invention is used as a sucker rod box or sucker rod guide, the slides 20 are preferably comprised of a metal that is softer than the metal comprising body 12 and the metal comprising the tubing. It is also preferred that the coefficient of friction of the metal comprising the slides 20 be relatively low so as to decrease the friction between the surface of the slides 20 and the metal comprising the tubing wall, thereby decreasing the wear on the slides 20 and the tubing. It is specifically preferred that the coefficient of friction of the metal comprising the slides 20 be lower than the coefficient of friction of the metal comprising body 12.

Referring again to FIGS. 1 and 2, the manner in which the slides 20 are affixed to the cylindrically-shaped body 12 will now be described. As best shown in FIG. 1, each of the slides 20 resides in one of the longitudinal grooves 22 formed in the outer surface 32 of body 12 and protrudes radially outwardly from the outer surface of the body 12. Each of the slides 20 is provided with a groove 34 in at least one side surface 36 thereof, and in the preferred embodiment shown in FIGS. 1–2, the slides 20 are provided with grooves 34 in both side surfaces 36 thereof By comparing FIG. 1 to FIG. 2, it can be seen that each of the slides 20 is affixed to body 12 by deforming the metal comprising body 12 into the groove 34 in the side surface 36 of the slides 20. In the presently preferred embodiment, this deformation is accomplished by striking the outer surface 32 of the body 12 adjacent the longitudinal grooves 22 with a die shaped so as to deform the wall of the longitudinal groove 22 inwardly into the groove 34 formed on the side surface 36 of the slide 20. The score lines 38 shown in FIGS. 3 and 4 result from the striking of the outer surface 32 of body 12 in this manner. In the preferred embodiment shown in the figures, the ends of the slides 20 are beveled as at reference numeral 40 so as to facilitate running the string of sucker rods downhole and to further reduce the friction between a slide 20 and, for instance, a curved or damaged section of the tubing downhole.

Those skilled in the art who have the benefit of this disclosure will recognize that the apparatus of the present: invention is not limited in scope to use as a sucker rod guide or sucker rod box. The present invention also contemplates the use of the apparatus of the present invention in any application in which a member is slidably mounted in a housing to minimize abrasive wear of the member and the housing upon sliding movement of the member in the housing. The apparatus of the present invention is, therefore, described herein as a sucker rod box and sucker rod guide (where the member is the sucker rod and the housing is the tubing lining the well bore) merely to exemplify the invention, not to limit the invention.

Those skilled in the art who have the benefit of this disclosure will also recognize that certain changes can be made to the component parts of the apparatus of the present invention without changing the manner in which those parts function to achieve their intended result. For instance, if the apparatus of the present invention is mounted to a member that slides within a housing that is not cylindrical, the body of apparatus of the present invention may be formed in a shape other than cylindrical. Further, neither the body 12 nor the slides 20 need necessarily be comprised of metal. Again depending upon the application of the apparatus of the present invention, either or both of the body 12 and/or slides 20 may be comprised of a resilient, pliable or less rigid material, for example, nylon, plastic, TEFLON® or other sinmilar low friction polymer or a composite material such as the material used for brake shoe linings (RAYBESTOS®). In one embodiment specifically contemplated herein, the slide 20 is comprised of a strip of material that is affixed to the body 12 at the ends of slide 20 in the manner described above and bowed out from the outer surface 32 of body 12 to provide a low bearing friction against the tubing wall and the advantages provided by a bow-spring centralizer, e.g., centering of the sucker rod in the well bore and/or standoff as the well bore deviates from vertical. All such changes, and others;:which will be clear to those skilled in the art from this description of the preferred; embodiments of the invention, are intended to fall within the scope of the following, non-limiting claims.

What is claimed is:

1. An apparatus for mounting to a member that is slidably mounted in a housing comprising:

a generally elongate body;

a plurality of longitudinal grooves in the outer surface of said body; and an elongate slide residing in said longitudinal grooves and protruding outwardly from the outer surface of said body, each slide having a groove in at least one side surface thereof, said body being deformed into the groove in the side surface of each of said slide for retaining said slide in said longitudinal groove.

2. The apparatus of claim 1 wherein said slide comprises grooves on both side surfaces thereof and said body is deformed into the grooves on both sides of said slide.

3. The apparatus of claim 1 wherein said slide is comprised of a material having a relatively low coefficient of friction.

4. The apparatus of claim 3 wherein said slide is also comprised of a material that is softer than the material comprising said body.

5. The apparatus of claim 1 wherein said body is cylindrical in shape and is provided with a bore therethrough for receiving the member to which said body is mounted.

6. The apparatus of claim 5 wherein said body is comprised of two sections, split along the longitudinal axis of said body, and means for selectively joining said sections around the member received in the bore therethrough.

7. The apparatus of claim 5 wherein the bore through said body is provided with threads for joining two threaded members.

* * * * *